US006581348B2

(12) United States Patent
Hunter, Jr.

(10) Patent No.: US 6,581,348 B2
(45) Date of Patent: Jun. 24, 2003

(54) SEAMLESS FOAM PANEL ROOFING SYSTEM

(76) Inventor: John P. Hunter, Jr., 344 Country Rd., 39A, Southampton, NY (US) 11968

( * ) Notice: Subject to any disclaimer, the term of this patent is extended or adjusted under 35 U.S.C. 154(b) by 0 days.

(21) Appl. No.: 10/022,612

(22) Filed: Dec. 18, 2001

(65) Prior Publication Data

US 2002/0189185 A1 Dec. 19, 2002

Related U.S. Application Data

(60) Provisional application No. 60/298,517, filed on Jun. 15, 2001.

(51) Int. Cl.[7] ..... E04B 7/00

(52) U.S. Cl. ..... 52/408; 52/412; 52/309.5; 52/309.8; 52/746.11; 52/741.4; 428/319.1; 156/71

(58) Field of Search ..... 52/408, 409, 412, 52/746.11, 747.1, 741.4, 745.06, 309.5, 309.8; 156/71, 78, 182; 428/319.1

(56) References Cited

U.S. PATENT DOCUMENTS

| | | | | |
|---|---|---|---|---|
| 1,835,402 A | | 12/1931 | Juers | |
| 2,176,891 A | | 10/1939 | Crom | |
| 2,770,216 A | | 11/1956 | Schock | |
| 3,027,095 A | | 3/1962 | Paasche | |
| 3,096,225 A | | 7/1963 | Carr | |
| 3,232,017 A | * | 2/1966 | Prusinski | 52/309.9 |
| 3,302,362 A | * | 2/1967 | Lang | 52/742.13 |
| 3,411,256 A | | 11/1968 | Best | |
| 3,548,453 A | | 12/1970 | Garis | |
| 3,583,118 A | | 6/1971 | Lowery | |
| 3,607,972 A | | 9/1971 | Kiles | |
| 3,641,720 A | | 2/1972 | Berrie | |
| 3,667,687 A | | 6/1972 | Rivking et al. | |
| 3,705,821 A | | 12/1972 | Breer et al. | |

(List continued on next page.)

FOREIGN PATENT DOCUMENTS

| | | | |
|---|---|---|---|
| GB | 2 055 326 A | 3/1981 | |
| GB | 2 169 329 A | 7/1986 | E04D/1/20 |

OTHER PUBLICATIONS

Polyurethane Foam & Insulation Roof System, Schmidt Roofing Services Veeville Texas. 2 pages. Copyright 2000–2003.*

Olympic Mfg Group, "OlyBond Adhesive Fastener", product data specification May 2001 pp. 1–4.

*Primary Examiner*—Carl D. Friedman
*Assistant Examiner*—Brian E. Glessner
(74) *Attorney, Agent, or Firm*—Alfred M. Walker

(57) ABSTRACT

A crush resistant seamless roofing system is formed by a layer of adjacent panels having loose joints filled by expanding rising foam adhesive, which is trimmed to remove excess foam adhesive above a top plane of the roofing system. The roofing system thus formed is covered by a fabric layer and a coating.

15 Claims, 4 Drawing Sheets

U.S. PATENT DOCUMENTS 3,741,482 A 6/1973 Eliason et al.
3,786,965 A 1/1974 James et al.
3,823,525 A 7/1974 Bruun
3,885,066 A 5/1975 Schwenninger
3,923,937 A 12/1975 Piccioli et al.
3,954,544 A 5/1976 Hooker
3,971,184 A 7/1976 Van Wagoner
3,984,270 A * 10/1976 Haage ..... 156/71
4,016,323 A 4/1977 Volovsek
4,021,981 A * 5/1977 Van Wagoner ..... 52/309.13
4,063,395 A * 12/1977 Stewart et al. ..... 52/309.5
4,087,296 A 5/1978 Hooker
4,096,303 A 6/1978 Doerfling
4,130,614 A * 12/1978 Saidla ..... 264/46.4
4,167,151 A 9/1979 Muraoka et al.
4,194,282 A 3/1980 Byrd, Jr.
4,209,557 A 6/1980 Edwards
4,210,098 A 7/1980 Harrison et al.
4,244,151 A 1/1981 Seem
4,282,697 A 8/1981 Spielau et al.
4,288,951 A * 9/1981 Carlson et al. ..... 52/94
4,303,722 A * 12/1981 Pilgrim ..... 428/213
4,333,973 A 6/1982 Bellafiore et al.
4,393,634 A * 7/1983 McDermott et al. ..... 52/309.1
4,400,425 A * 8/1983 Vanha ..... 442/224
4,474,135 A 10/1984 Bellafiore
4,486,994 A 12/1984 Fisher et al.
4,521,458 A 6/1985 Nelson
4,567,230 A 1/1986 Meyer et al.
4,630,567 A 12/1986 Bambousek et al.
4,641,468 A 2/1987 Slater
4,651,494 A 3/1987 Van Wagoner
4,659,018 A 4/1987 Shulman
4,736,552 A 4/1988 Ward et al.
4,748,781 A 6/1988 Wencley
4,754,583 A 7/1988 Jenn
4,774,794 A 10/1988 Grieb
4,788,803 A 12/1988 Seitz
4,837,095 A 6/1989 Hageman
4,903,446 A 2/1990 Richards et al.
4,983,426 A 1/1991 Jordan
4,996,812 A * 3/1991 Venable ..... 52/408
5,070,670 A 12/1991 Alderson
5,072,569 A 12/1991 VanTassel
5,098,024 A 3/1992 MacIntyre
5,141,363 A 8/1992 Stephens
5,231,813 A 8/1993 Drawdy
5,248,341 A 9/1993 Berry, Jr. et al.
5,269,109 A 12/1993 Gulur
5,279,088 A 1/1994 Heydon
5,317,852 A * 6/1994 Howland ..... 52/408
5,344,700 A 9/1994 McGath et al.
5,381,597 A 1/1995 Petrove
5,381,638 A 1/1995 Andersson
5,394,672 A * 3/1995 Seem ..... 52/794.1
5,441,583 A * 8/1995 Eaton et al. ..... 156/71
5,457,917 A 10/1995 Palmersten
5,509,242 A 4/1996 Rechsteiner et al.
5,600,929 A * 2/1997 Morris ..... 52/309.8
5,620,554 A 4/1997 Venable
5,670,178 A 9/1997 West
5,695,870 A * 12/1997 Kelch et al. ..... 428/318.4
5,771,649 A 6/1998 Zweig
5,815,989 A 10/1998 Bennenk et al.
5,872,203 A 2/1999 Wen et al.
5,921,046 A 7/1999 Hammond, Jr.
5,950,397 A 9/1999 Ginn et al.
5,987,835 A 11/1999 Santarossa
5,992,110 A 11/1999 Clear
6,006,480 A 12/1999 Rook
6,024,147 A 2/2000 Hunter, Jr.
6,061,995 A 5/2000 Menchetti et al.
6,117,256 A 9/2000 Hunter, Jr.
6,126,766 A 10/2000 Hunter, Jr.
6,164,021 A 12/2000 Huber et al.
6,167,624 B1 1/2001 Lanahan et al.
6,185,891 B1 2/2001 Moore
6,193,826 B1 2/2001 Starr et al.
6,205,728 B1 3/2001 Sutelan
6,206,991 B1 3/2001 Starr
6,358,344 B1 3/2002 Hunter, Jr.
6,416,854 B2 7/2002 Hunter, Jr.
6,418,687 B1 * 7/2002 Cox ..... 52/309.4

* cited by examiner

SEAMLESS FOAM PANEL ROOFING SYSTEM

This application claims benefit of U.S. Provisional application Ser. No. 60/298,517, filed Jun. 15, 2001.

FIELD OF THE INVENTION

The present invention relates to roofing systems.

BACKGROUND OF THE INVENTION

Rigid foam panels are currently available for use as an insulating underlayment in roof construction. Typically these are 4' by 8' (1.22 m by 2.44 m) panels 1.5" (3.8 cm) thick made of a 1.6 pound per cubic foot polyurethane foam with a tar paper top layer. Such a material is not crush resistant enough to be used as a roof surface material and can also be easily punctured.

OBJECTS OF THE INVENTION

It is therefore an object of the present invention to provide a sturdy, weatherproof, seamless roofing system that uses rigid foam boards or panels to create a seamless waterproof roof.

SUMMARY OF THE INVENTION

The roofing panels of this invention differ from the prior art underlayment product in several respects. The panels of this invention are:

a) made of a denser polyurethane foam (approximately 3 pounds per cubic foot) and, b) include an integral top layer of non-woven 250 gram polyester fabric that is saturated by the foam during manufacture by the laminator in a controlled factory environment.

The higher density affords more crush resistance, while the well bonded top layer resists punctures and provides a better adhesion surface for elastomeric top coats.

The roofing panels are bonded to roof substrate with low rise foam polyurethane adhesive which seeps through loose tongue-in-groove joints to form a blob at the top, which is shaved off and covered with a fabric top layer.

After the adhesive cures, a very secure bond between the panels results.

The low rise foam adhesive is a two-part mixture that has distinct phases after mixing. By varying the formulations of the two parts, the "cream time" (i.e.—to achieve the consistency of shaving cream) as well as the "tack free" time can be controlled.

The panels are placed on the foam just after cream consistency and well before tack-free time so that the foam rises through the joints. After the adhesive cures to a solid consistency, the blobs are removed from all of the joints. This is typically accomplished by grinding using a disk pad grinder.

The roof is finished by applying a layer of waterproof elastomeric coating which covers the entire surface creating a monolithic structure.

BRIEF DESCRIPTION OF THE DRAWINGS

The present invention can best be understand in connection with the accompanying drawings, in which.

DETAILED DESCRIPTION OF THE INVENTION

The roofing system of this invention uses rigid foam boards or panels to create a seamless waterproof roof. It can be used over a number of different substrates including metal decking, tar and gravel, or polyurethane foam in new construction as well as re-roofing applications.

Rigid foam panels are currently available for use as insulating underlayment in roof construction. Typically these are 4' by 8' (1.22 m by 2.44 m) panels 1.5" (3.8 cm) thick made of a 1.6 pound per cubic foot polyurethane foam with a tar paper top layer. Such a material is not crush resistant enough to be used as a roof surface material and can also be easily punctured.

The roofing panels of this invention differ from this underlayment product in several respects. Although panel size as well as material are similar, the panels of this invention are made of a denser polyurethane foam (approximately 3 pounds per cubic foot) and include an integral top layer of non-woven 250 gram polyester fabric that is saturated by the foam during manufacture by the laminator in a controlled factory environment. The higher density affords more crush resistance, while the well bonded top layer resists punctures and provides a better adhesion surface for elastomeric top coats.

Figure 1:
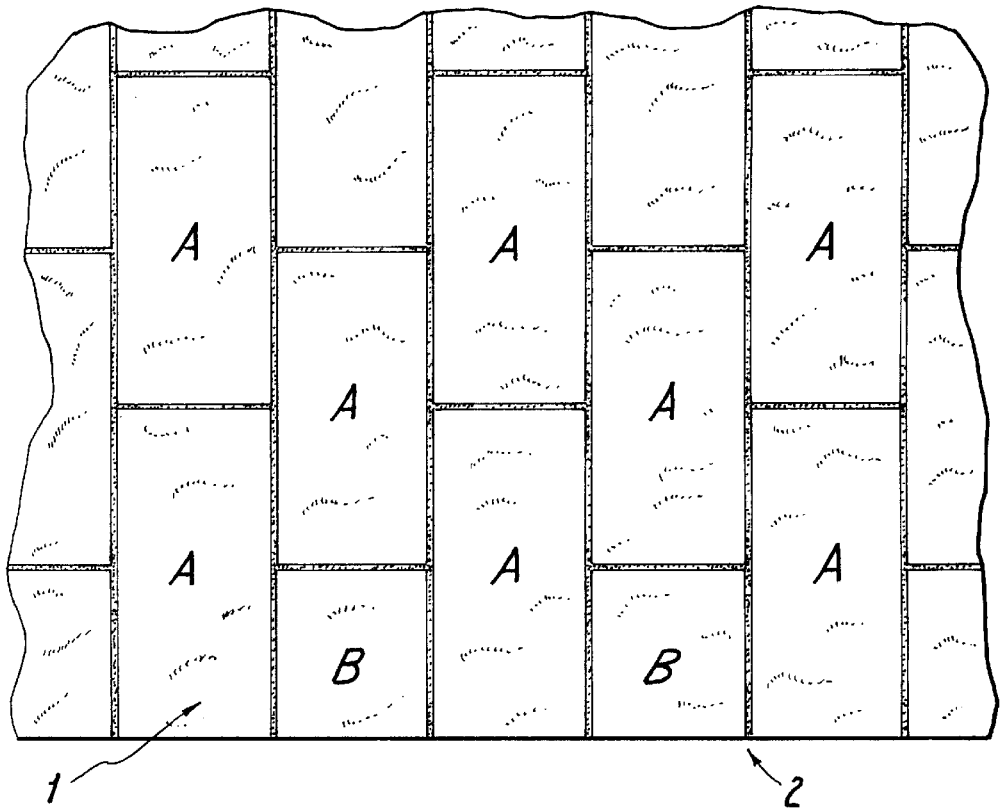
FIG. 1 is a top plan view of a roof section; showing outlines of roofing panels of this invention.

FIG. 1 is a top view of a roof 1 section showing the outline of the individual roof panels. The panel seams are staggered by using alternate whole panels A as well as half panels B at the roof edge 2. This is done to prevent any tendency for propagation of inadvertent seam separations.

Figure 2:
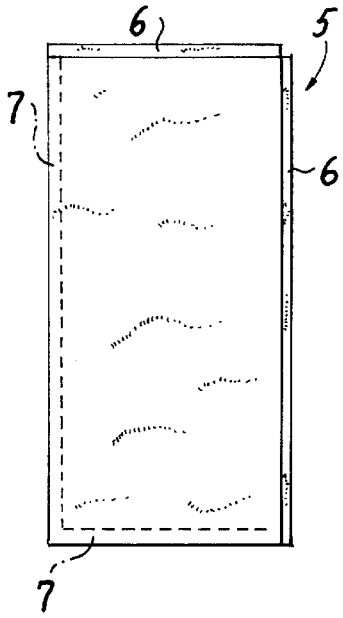
FIG. 2 is a top plan view of an embodiment for a tongue-in-groove roofing panel of this invention.

FIG. 2 shows a top view of a tongue-in groove panel 5 tongue edges 6 and groove edges 7.

Figure 3:
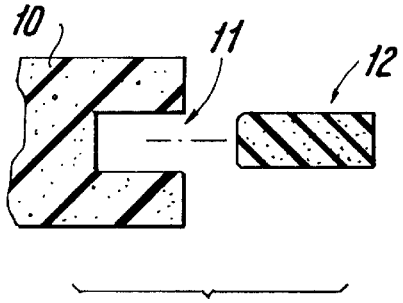
FIG. 3 is an edge crossection detail view of further embodiment for an all-groove panel of this invention with an insertable tongue board.

Since a protruding tongue of polyurethane foam could be damaged in transit, an alternate embodiment of a tongue-in groove construction is shown in FIG. 3. In this all-groove construction, each polyurethane panel 10 has grooves 11 cut in all four edges. A length of polyurethane plank 12 is then inserted in groove 11 on two edges at the work site. Plank 12 is dimensioned as a press fit in groove 11 and protrudes from the edge to form the tongue after insertion. Planks 12 would be shipped separately in protective packaging to the work site.

Figure 4:
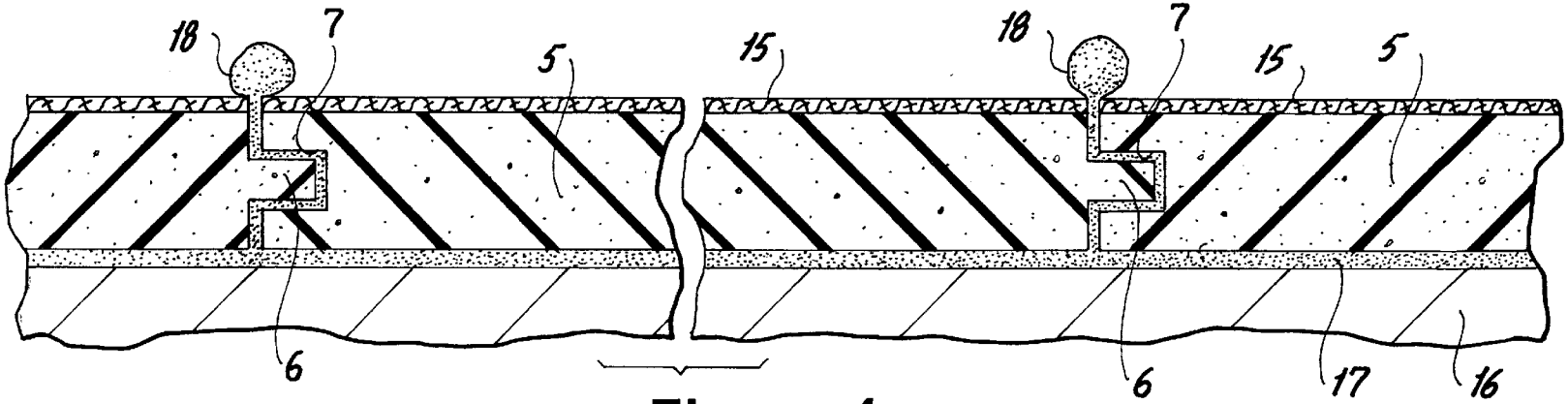
FIG. 4 is an edge crossection view of yet another embodiment for tongue-in-groove roofing panels of this invention, shown adhesively bonded to a roof substrate.

FIG. 4 is an edge crossection view of roofing panels 5 bonded to roof substrate 16 with low rise foam polyurethane adhesive 17 which seeps through loose tongue-in-groove joints to form a blob 18 at the top. Factory bonded fabric 15 is a top layer. Typically, the groove 7 is ⅞" (22 mm) wide while the tongue is ¾" (19 mm) wide; this affords enough space for the adhesive foam to rise through while affording close line-up of the top surfaces of adjacent boards 5. After adhesive 17 cures, a very secure bond between panels 5 results.

Figure 5:
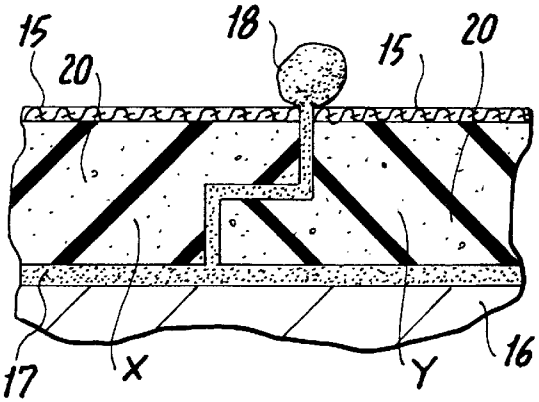
FIG. 5 is an edge crossection detail view of a still further alternate embodiment of this invention, shown with a ship-lap joint configuration.
Figure 7:
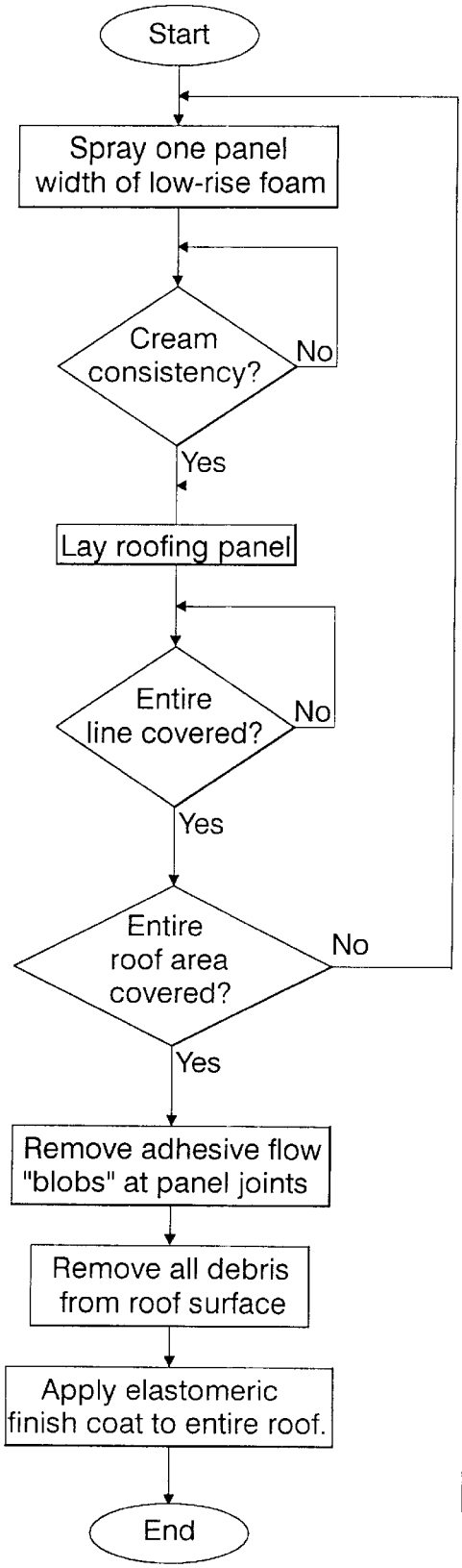
FIG. 7 is a high level flow chart of the roofing system method of this invention; and, FIG. 8 is a roof edge detail view in crossection, illustrating flashing and interfacing to the roofing system of this invention.

FIG. 5 is a detail of an alternative panel joint. Here panels 20 have a ship-lap edge which is also dimensioned so as to permit rising foam adhesive to flow through the joint. For ship-lap panels 20, the order in which they are laid into the foam is important.

As shown in FIG. 5, panel X should be laid down before panel Y so that there would not be a tendency to lift panel Y during the foam rising phase.

Foam adhesive is a two-part mixture that has distinct phases after mixing. By varying the formulations of the two parts, the "cream time" (i.e.—to achieve the consistency of shaving cream) as well as the "tack free" time can be controlled. For this invention, a cream time of about 1 minute and a tack-free time of about 4 minutes is ideal. The panels are placed on the foam just after cream consistency and well before tack-free time so that the foam rises through the joints.

After the adhesive cures to a solid consistency, the blobs 18 are removed from all of the joints. This is typically accomplished by grinding using a cutter, such as a knife or disk pad grinder. At this stage, the joint is flush with the fabric top surface of the adjacent panels.

The roof is finished by applying a layer of waterproof elastomeric coating which covers the entire surface creating a monolithic structure.

Figure 6:
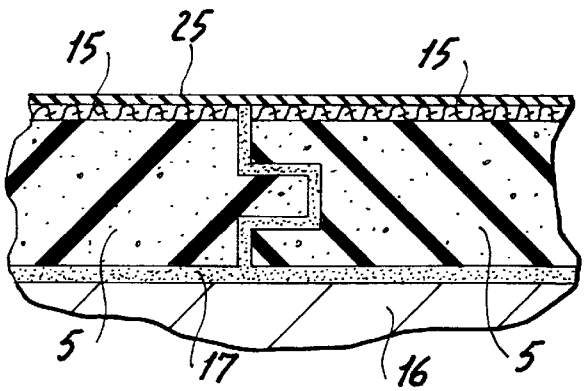
FIG. 6 is an edge crossection detail view showing a panel joint of this invention in a finished roof section.

FIG. 6 is a detail of a finished joint between two panels 5 after the blob 18 has been removed and elastomeric coating 25 has been applied. Coating 25 can be an acrylic, urethane or silicone material. It can be sprayed or brushed on.

Flow chart 7 is a concise description of the overall installation process. Two people are generally involved as a team. One worker sprays a panel-width line of low rise polyurethane adhesive, while the second worker follows (after the mix is of cream consistency) and lay down panels. As per FIG. 1, the first panel at an edge is either a full or half panel to create the staggered seam pattern. Only after the entire roof (or large section) is paneled, are the seep-through joint blobs removed. All debris must be removed carefully before a final seal coat is applied.

Penetrations and wall flashings are first sealed with spray foam prior to sealing.

Figure 8:
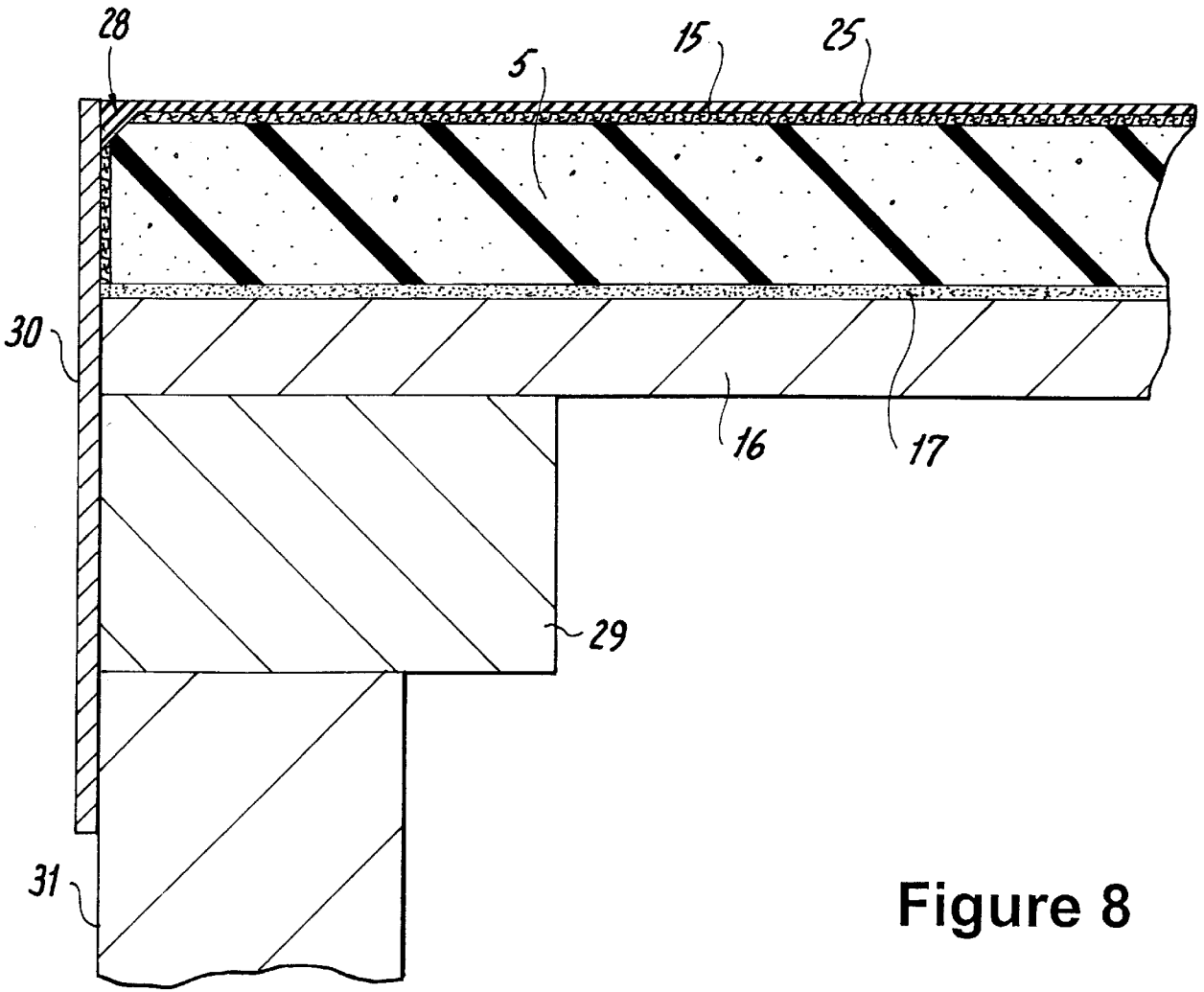

FIG. 8 is a detail at a roof edge showing an end panel 5 interfacing with aluminum edging 30 which bridges wall 31, beam 29 and foam panel 5. A V-groove 28 is cut from the corner of panel 5 at the juncture of edging 30 to permit an aluminum surface to be bonded and sealed to the fabric 15 top layer by waterproof coating 25.

It is further noted that other modifications may be made to the present invention, within the scope of the invention, as noted in the appended claims.

I claim:

1. A method of installing roofing tiles comprising:

a) spraying a foam rising adhesive on a surface;

b) waiting for said foam rising adhesive to obtain a creamy consistency;

c) applying a first tile panel and an adjacent first subsequent tile panel to said surface;

d) waiting for said adhesive to cure and rise within a joint formed between said first tile panel and said first subsequent tile panel;

e) applying further tile panel and subsequent further tile panel to said surface;

f) waiting for said adhesive to cure and rise within further joints formed between said first subsequent tile and said further tile panel;

g) repeating steps "c", "d" and "e" and "f" on next subsequent pairs of tile panels until said foam adhesive completes rising between said joints and accumulates as debris above a plane formed by said tile panels accumulated in a seamless configuration;

h) removing debris formed by said foam rising adhesive from the top surface of said tile panels; and, I) applying an elastomeric coat to the top surface of said joined, seamless accumulation of tile panels.

2. A method of installing roofing tiles according to claim 1, wherein said elastomer is an acrylic.

3. A method of installing roofing tiles according to claim 1, wherein said elastomer is a urethane.

4. A method of installing roofing tiles according to claim 1, wherein said elastomer is silicone based.

5. A method of installing roofing tile panels according to claim 2, wherein application of said first and said subsequent tile panels further comprises:

applying said first tile panel having a first length; and applying said second tile panel having a second length, wherein said second length of said second tile panel is different than said first length of said first tile panel.

6. A crush resistant and puncture resistant seamless waterproof roofing system comprising a plurality of adjacent cured foam panels attached to a roofing by a foaming adhesive bonding said panels to a substrate of said roof, said adhesive rising between said panels, sealing said panels to each other by expansion through loose inter-panel joints between said panels, said panels having an on-site coat of elastomeric sealing material thereon, said coat of elastomeric sealing material covering a fabric layer above each of said panels.

7. The roofing system as in claim 6 wherein said panels are polyurethane.

8. The roofing system as in claim 6 wherein said sealing material is a silicone.

9. The roofing system as in claim 7 wherein said polyurethane is a dense polyurethane foam having a strength of at least three pounds per cubic foot.

10. The roofing system as in claim 6 wherein said fabric is an integral top layer of non-woven 250 gram polyester fabric saturated by said foam.

11. The roofing system as in claim 10 wherein adjacent panels have tongue-in-groove edges fitting into adjacent tongue and groove edges of adjacent panels.

12. The roofing system as in claim 11 wherein said adhesive is low rise foam polyurethane adhesive, said adhesive seeping through loose tongue-in groove joints.

13. The roofing system as in claim 6 wherein said foaming adhesive used to both bond the said panels to a substrate and to rise between said panels, seals said panels to each other through loose inter-panel joints accommodating said risen adhesive therebetween, forming a seamless accumulation of said panels.

14. The roofing system as in claim 6 wherein said roof has panel seams which are staggered by using alternate whole panels as well as half panels upon said roof.

15. The roofing system as in claim 6 wherein said plurality of panels includes an edging bridging a wall under said roof, a support beam supporting said panels, and said panels.

* * * * *